United States Patent [19]

Ohno et al.

[11] Patent Number: 4,911,119

[45] Date of Patent: Mar. 27, 1990

[54] OIL PUMP MOUNTING SYSTEM FOR INTERNAL COMBUSTION ENGINES

[75] Inventors: Katuhiko Ohno; Keisuke Ishii; Motoaki Etoh, all of Tokyo, Japan

[73] Assignee: Fuji Jukogyo Kabushiki Kaisha, Tokyo, Japan

[21] Appl. No.: 270,096

[22] Filed: Nov. 14, 1988

[30] Foreign Application Priority Data

Nov. 13, 1987 [JP] Japan ..... 62-173435[U]

[51] Int. Cl.[4] ..... F01M 1/00

[52] U.S. Cl. ..... 123/196 W; 184/6.18; 184/26

[58] Field of Search ..... 123/196 R, 196 W; 184/6.18, 26

[56] References Cited

U.S. PATENT DOCUMENTS 4,662,328 5/1987 Kronich ..... 123/198 C

FOREIGN PATENT DOCUMENTS 241662 8/1960 Australia ..... 123/196 W 159388 8/1985 Japan ..... 123/196 W

*Primary Examiner*—E. Rollins Cross

*Attorney, Agent, or Firm*—Beveridge, DeGrandi & Weilacher

[57] ABSTRACT

An oil pump mounting system for an internal combustion engine of the type in which the oil pump is disposed in a pump housing formed integrally with an oil pan and feeds an oil into an oil passage extended through the output shaft of the engine. The oil pump mounting system comprises a driving shaft of the oil pump supported at both ends by the output shaft of the engine and a bearing portion formed in the oil pan, and an oil suction port formed through one side of the pump housing communicated with the surface of the oil pump on the side of the bearing portion. Thus ensuring operation even when the engine is inclined.

2 Claims, 4 Drawing Sheets

OIL PUMP MOUNTING SYSTEM FOR INTERNAL COMBUSTION ENGINES

BACKGROUND OF THE INVENTION

The present invention relates to an oil pump mounting system for internal combustion engines, and that is capable of ensuring operation even when the engine is inclined.

As is well known to those skilled in the art, an oil pump mounting system of the type disclosed in, for instance, Japanese Utility Model Publication No. 56-27367 or Japanese Utility Model Laid-Open Publication No. 60-70703 is incorporated in a vertical shaft type engine mounted on a lawn mower or the like.

In the case of the oil pump mounting system of the type described above, an oil pump is mounted in an oil pan through a mount hole formed through one wall thereof and the mount hole is then closed with a cover with bolts and nuts or any other suitable joint means. As the engine is started, the oil pump is rotated so that oil stored in the oil pan is distributed to various parts for lubrication.

However, in the case of the oil pump mounting system of the type described above, due to vibrations caused by the operation of the engine, the bolts are loosened so that there is a fear that the oil stored in the oil pan leaks.

In order to solve this problem, there has been devised and demonstrated an oil pump mounting system as shown in FIG. 5.

That is, an oil pan 1 is formed integrally with a pump housing 2, and a bearing 5 for supporting an output shaft 4 of an engine 3 is securely mounted on the top of the pump housing 2. A space defined by the bearing 5 and the pump housing 2 is used as a rotor chamber 7 in which an oil pump 6 is housed.

When the engine 3 is started, the output shaft 4 is rotated so that a driving shaft 8 of the oil pump 6 joined to the output shaft 4 with a pin 4*a* is rotated. Therefore, the oil within the oil pan 1 flows through a suction port 9 defined between the top of the pump housing 2 and the bearing 5 to the top of the rotor chamber 7 and then is increased in pressure by the oil pump 6 and distributed to rotating parts of the engine 3 through an oil passage 4*b* extending through the output shaft 4.

In the conventional oil pump mounting system of the type just described above, however, since the suction port 9 is defined between the top of the pump housing 2 and the bearing 5, an opening 9*a* of the suction port 9 is exposed above the level of the oil when the engine 3 is inclined so that the flow of the oil into the pump housing is adversely affected. In order to solve this problem, a relatively large quantity of oil must be stored in the oil pan 1 and it is difficult to mount the engine 3 at a position below a predetermined height.

Furthermore, one end of the driving shaft 8 of the oil pump 6 is joined with the pin 4*a* to the output shaft 4 of the engine 3 so that, when the engine 3 is inclined, the driving shaft 8 is also inclined to adversely affect so that the smooth and reliable operation of the oil pump 6 can be attained.

SUMMARY OF THE INVENTION

The present invention was, therefore, made to substantially solve the above and other problems encountered in conventional oil pumps and has the object to provide an oil pump for internal combustion engines which can ensure the flow of the oil into the pump housing as well as the smooth rotation of the pump driving shaft even when the engine is inclined, so that the operation of the engine is not adversely affected even when the engine is inclined and so that the engine can be mounted at a lower position.

In oil pumps of the type in which an oil pump is housed within a pump housing formed integrally with an oil pan and the oil pump supplies oil into an oil passage extending through the output shaft of an engine, according to the present invention, the driving shaft of the oil pump is supported at both ends by the output shaft and a bearing mounted on the pump housing, respectively, and an oil suction port formed through one side wall of the pump housing is communicated with the surface on the side of the bearing of the oil pump.

It follows, therefore, that when the output shaft of the engine is rotated, the driving shaft which is supported at both ends by the output shaft and the bearing is also rotated so that oil in an oil pan is forced to flow through a suction port to the bottom surface side of the oil pump and then has its pressure increased by the oil pump so as to be distributed to the rotating parts of the engine for lubrication.

DETAILED DESCRIPTION OF THE PREFERRED EMBODIMENTS

Referring now to FIGS. 1—4, a preferred embodiment of an oil pump in accordance with the present invention will be described in detail hereinafter.

Figure 4:
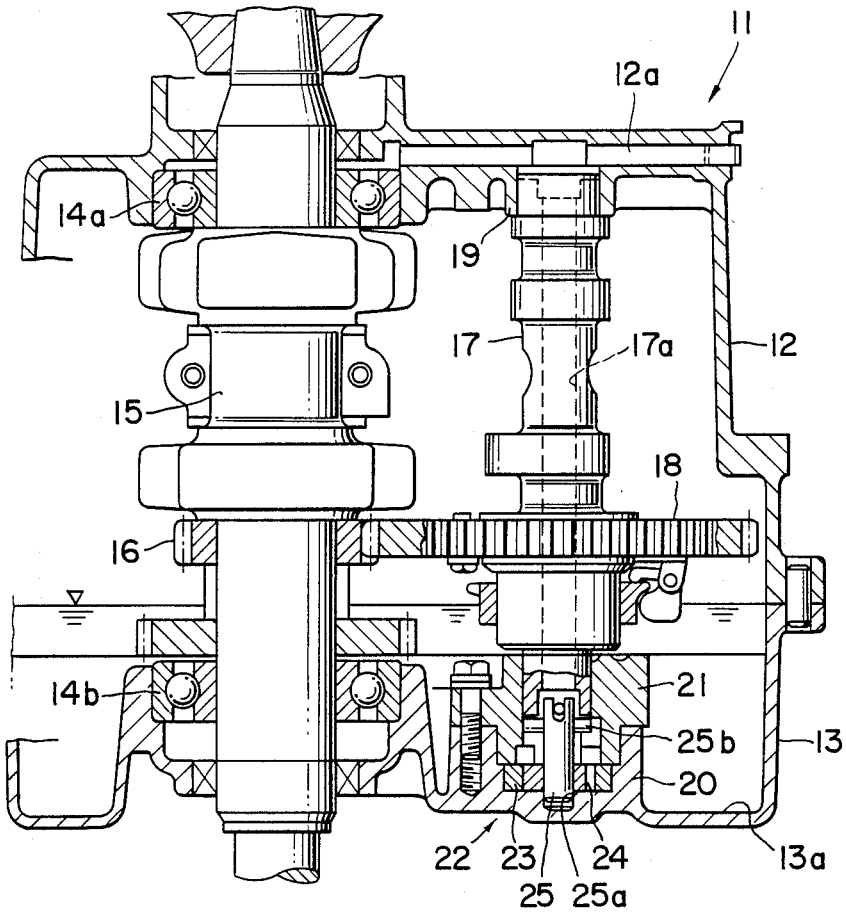
FIG. 4 is a vertical sectional veiw of an internal combustion engine.
Figure 5:
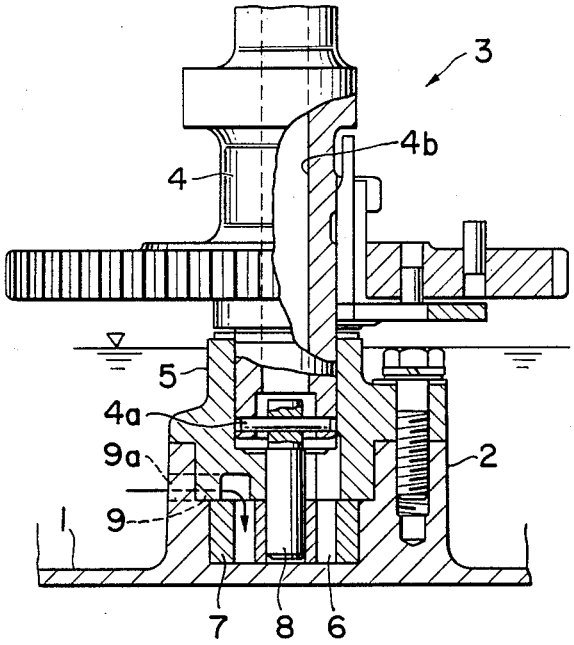
FIG. 5 PRIOR ART
FIG. 5 is a vertical sectional view of a conventional oil pump.

In FIG. 4 reference numeral 11 designates, for instance, the main body of a vertical shaft engine; 12, a crankcase; and 13, an oil pan which is disposed below the crankcase 12 and stores therein a predetermined quantity of oil.

A crankshaft 15 which is supported at its both ends by bearings 14*a* and 14*b* is rotatably and vertically extended between the crankcase 12 and the oil pan 13 and carries a gear 16 on the side of the oil pan 13. The gear 16 meshes with a cam gear 18 fixed to a cam shaft 17 or an output shaft of the engine which is extended parallel to the crankshaft 15.

The upper end of the cam shaft 17 is supported by a bearing portion 19 formed integrally with the crankcase 12 while the lower end thereof is supported by a bearing 21 securely joined to a pump housing 20 of the oil pan 13.

Figure 1:
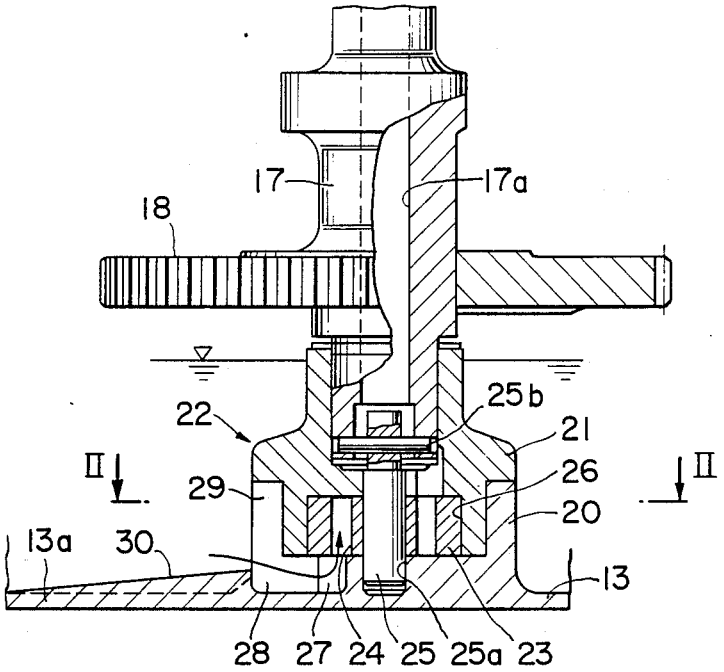
FIG. 1 is a vertical sectional view of a preferred embodiment of an oil pump in accordance with the present invention.
Figure 2:
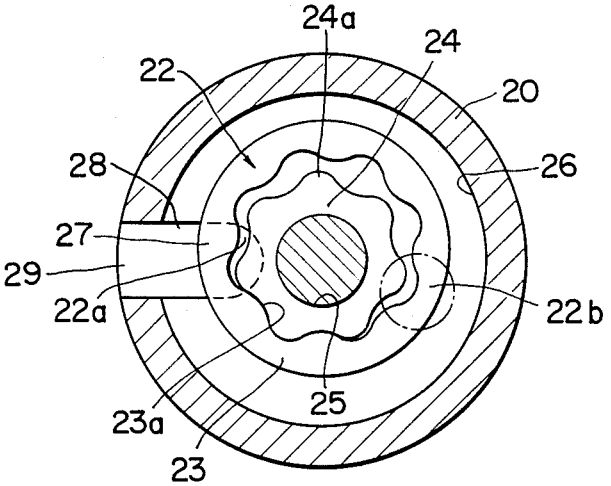
FIG. 2 is a cross sectional view, on enlarged scale, taken along the line II—II of FIG. 1.
Figure 3:
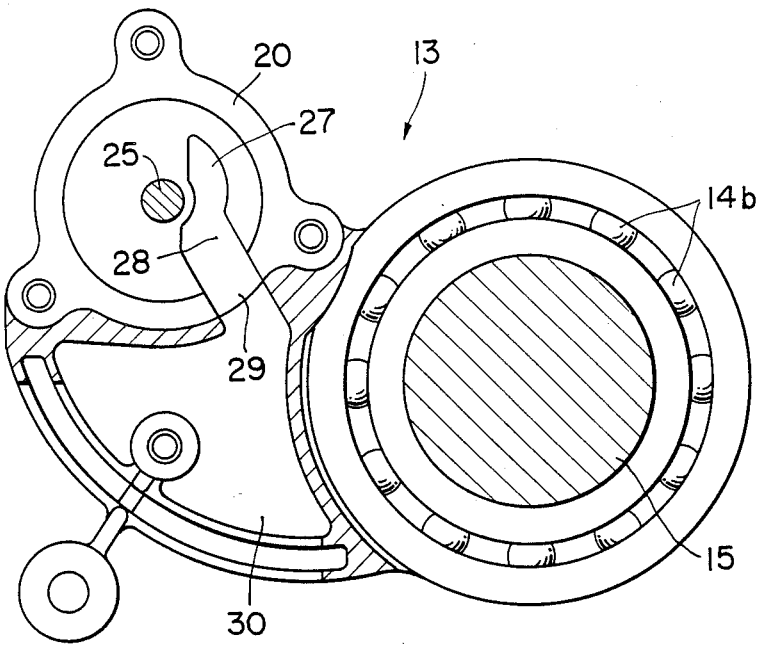
FIG. 3 is a top view of an oil pump housing.

As is best shown in FIG. 1, the pump housing 20 is formed integral with the oil pan 13 and is engaged with the bearing 21. A space defined by the bearing 21 and the pump housing 20 is a rotor chamber 26 which in turn is communicated with the rotating parts such as the main bearing 14*a* through an oil passage 17*a* extending through the cam shaft 17 coaxially thereof and a supply passage 12*a* defined in the crankcase 12.

Furthermore, a trochoid pump 22 which is one kind of oil pump, is disposed within the rotor chamber 26 and comprises an outer rotor 23 with internally threaded teeth 23*a* and an inner rotor 24 with externally threaded teeth 24*a* meshing with the treaded teeth 23*a*. The driving shaft 25 of the pump 22 is securely fitted into and extended through the inner rotor 24.

The lower end of the driving shaft 25 is supported by a bearing portion 25*a* formed in the oil pan 13 while the upper end thereof is joined to the lower end of the cam shaft 17 with a pin 25*b*. Upon rotation of the cam shaft 17, the driving shaft 25 is rotated so that the internally and externally threaded teeth 23*a* and 24*a* are caused to rotate while continuing to mesh with each other. Furthermore, the trochoid pump 22 is provided with an inlet 22*a* and an outlet 22*b*.

An oil inlet port 27 is opened opposite the inlet 22*a* at the bottom surface of the trochoid pump and is communicated with an oil suction port 29 formed through one side wall of the pump housing 20 by a recess 28 in the oil pan 13 which recess provides a suction passage below the rotor chamber 26. It follows, therefore, that when the trochoid pump 22 is rotated, the oil stored in the oil pan 13 is sucked into the oil suction port 29 to flow through the recess or suction passage 28 and the inlet port 27 into the rotor chamber 26.

A ramp 30 slopes up from a bottom surface 13*a* of the oil pan 13 to the lower portion of the oil suction port 29 so that, when the oil is sucked into the suction port 29, metal particles and the like deposited on the bottom surface 13*a* are intercepted by the ramp 30, which prevents them from entering through the oil suction port 29 into the rotor chamber 26.

Next the mode of operation of the embodiment with the above-described apparatus will be described.

When the engine is started, the crankshaft 15 and the gear 16 carried thereby are rotated so that the cam shaft 17 is also rotated through the cam gear 18 meshing with the gear 16 and consequently the driving shaft 25 of the trochoid pump 22 joined to the cam shaft 17 is rotated.

The upper end of the driving shaft 25 is connected to the cam shaft 17 with the pin 25*b* while the lower end thereof is supported by the bearing portion 25*a* formed in the oil pan 13 so that, even when the engine is driven in the inclined state, the driving shaft 25 is not inclined with respect to the cam shaft 17. Therefore there is no friction due to the contact of the inner rotor 24 carried by the driving shaft 25 with the bottom surface of the rotor chamber 26, thus ensuring the smooth operation of the pump 22.

When the inner rotor 24 is rotated in unison with the driving shaft 25, the outer rotor 23 is caused to rotate also in the same direction through the intermeshing threaded teeth 24*a* and 23*a* so that the oil stored in the oil pan 13 is sucked into the suction port 29.

Metal particles and the like produced by, for instance, the meshing of gears 16 and 18 are deposited on the bottom surface 13*a* of the oil pan 13 and forced to move toward the suction port 29 when the oil flows toward the oil suction port 29. However, the ramp 30 sloping up from the bottom surface 13*a* of the oil pan 13 to the lower portion of the suction port 29 intercepts metal particles and the like suctioned by the oil flowing toward the oil suction port 29 so that the suction of metal particles and the like into the oil suction port 29 can be prevented.

The oil sucked into the suction port 29 flows through the suction passage 28 or recess and the inlet port 27 into the rotor chamber 26.

The inlet port 27 is defined at the lower surface of the rotor chamber 26 so that the oil flowing out of the inlet port 27 flows toward the lower end of the trochoid pump 22. The oil suction port 29 is formed through the side surface of the pump housing 20 and the suction passage 28 intercommunicating between the oil suction port 29 and the inlet port 27 is defined below the rotor chamber 26. Therefore, even when the engine remains in an inclined position, the flow of the oil into the rotor chamber 26 is not adversely affected at all.

The oil introduced into the rotor chamber 22 is increased in pressure by the trochoid pump 22 housed within the rotor chamber 26 and is delivered to the rotating parts such as the main bearing 14*a* through the oil passage 17*a* and the supply passage 12*a*. After lubricating the rotating parts such as the bearing 14*a*, the oil drops to return to the oil pan 13.

In this embodiment, the ramp 30 is slopes up from the bottom surface 13*a* of the oil pan to the lower portion of the oil suction port 29, the present invention can attain the effect that the intrusion of metal particles and the like deposited on the bottom surface 13*a* into the rotor chamber 26 can be prevented. It is to be understood that means for preventing the suction of metal particles and the like into the oil suction port 29 is not limited to the above-described ramp 30 and that any other suitable means such as a barrier may be utilized.

In addition, it is also to be understood that the output shaft of the engine is not limited to the cam shaft 17 and that the oil pump is not limited to the trochoid pump 22 of the type described above.

As described above, with the oil pump mounting system in accordance with the present invention for use in the internal combustion engines, even when the engine is inclined, the adverse effect on the flowing of the oil into the pump housing can be avoided; the effective quantity of the oil used can be increased so that it is not necessary to store a large quantity of oil in the oil pan; and the capability of the operation of the engine in the inclined state can be improved.

Furthermore, in response to the decrease in quantity of oil stored in the oil pan, the engine can be mounted at a lower position.

Moreover, the oil-pump driving shaft is supported at both ends so that, even when the engine is inclined, the smooth, reliable and dependable operation of the oil pump can be ensured.

What is claimed is:

1. An oil pump mounting system for an internal combustion engine having an oil pan integrally provided on a bottom portion of the engine for storing a quantity of oil, an oil pump including inner and outer rotors and an inlet port provided at a bottom surface thereof, and shaft means for operatively connecting the inner rotor with an output shaft of the engine, the system comprising:

bearing means for rotatably supporting the shaft means at an upper end thereof and having a chamber in a lower portion thereof to rotatably support the outer rotor, and housing means formed on a bottom portion of the oil pan for supporting the lower end of the bearing means, said housing means having an oil suction port through a side wall thereof and a recess in an inner bottom surface thereof which communicates with the suction port and an inlet port of said oil pump to provide a suction passage between the lower end of the bearing means and the housing means, so as to induce the oil in the oil pan to the inlet port.

2. The oil pump mounting system according to claim 1 wherein a ramp slopes up from bottom surface of said oil pan to a lower portion of said suction port, whereby metal particles and the like deposited on said bottom surface are prevented from entering into a rotor chamber through said suction port.

* * * * *